US012480741B2

(12) United States Patent
Brandt

(10) Patent No.: US 12,480,741 B2
(45) Date of Patent: Nov. 25, 2025

(54) TOGGLE LOCKING MECHANISM FOR A FIREARM HOLSTER

(71) Applicant: Ryan David Brandt, Saint Marys, OH (US)

(72) Inventor: Ryan David Brandt, Saint Marys, OH (US)

( * ) Notice: Subject to any disclaimer, the term of this patent is extended or adjusted under 35 U.S.C. 154(b) by 91 days.

(21) Appl. No.: 18/639,283

(22) Filed: Apr. 18, 2024

(65) Prior Publication Data

US 2025/0327640 A1 Oct. 23, 2025

(51) Int. Cl.
*F41C 33/02* (2006.01)

(52) U.S. Cl.
CPC ..... *F41C 33/0263* (2013.01); *F41C 33/0209* (2013.01)

(58) Field of Classification Search
CPC ..... F41C 33/0209; F41C 33/0272; F41C 33/0236; F41C 33/0263; Y10S 224/911; Y10S 224/912
USPC ..... 224/244
See application file for complete search history.

(56) References Cited

U.S. PATENT DOCUMENTS 5,513,785 A 5/1996 Campagna, Jr.
6,467,660 B2 10/2002 Rogers et al.
6,732,891 B2 5/2004 Locklear, III
7,530,456 B1 * 5/2009 Tsai ..... F41C 33/0263 224/244
8,177,108 B1 5/2012 Kincaid et al.
RE44,428 E 8/2013 Spielberger
8,602,276 B2 * 12/2013 Tyybakinoja ..... F41C 33/0263 224/198
8,646,665 B2 2/2014 Abushaev
8,720,754 B2 5/2014 Kirsch
9,057,580 B2 6/2015 Rorick et al.
10,267,595 B2 * 4/2019 Garibaldi ..... F41C 33/0272
10,837,735 B2 11/2020 Chester
11,215,422 B2 1/2022 Yeates
2004/0050887 A1 3/2004 Spielberger
2011/0011904 A1 1/2011 Schultz et al.
2015/0247701 A1 * 9/2015 Faifer ..... F41C 33/0209 224/244
2015/0285587 A1 10/2015 Abushaev
2016/0313088 A1 10/2016 Gregory et al.
2019/0178609 A1 * 6/2019 Horlacher ..... F41C 33/0209

* cited by examiner

*Primary Examiner* — Corey N Skurdal
(74) *Attorney, Agent, or Firm* — Dunlap Bennett & Ludwig, PLLC

(57) ABSTRACT

A slide-locking mechanism for a firearm holster is disclosed. The holster is sized and configured for retaining a firearm. The firearm defines a gun body having a trigger guard. The holster defines a pocket, a lock guide, and a cavity. The pocket is sized and configured for retaining the trigger guard. The lock guide includes a spaced-apart pair of slots; and the cavity is located between the slots.

6 Claims, 5 Drawing Sheets

TOGGLE LOCKING MECHANISM FOR A FIREARM HOLSTER

BACKGROUND OF THE INVENTION

The present subject matter, in general, relates to a holster. The present subject matter, more particularly, relates to a slide-locking mechanism for a firearm holster.

While most holsters originally lacked firearm retention mechanisms, current holsters have rather complex firearm retention mechanisms. For instance, U.S. Pat. No. 11,397,069 to Smith et al. describes a holster having a lockout button assembly. The lockout assembly includes an elongated member. The closer end of the elongated member is called its "proximal" end, and its opposite end is called its "distal" end. The lockout button assembly has a lockout button portion and a blocking portion. The lockout button portion is on the proximal end and the blocking portion is on the distal end. The lockout button assembly is slidingly mounted for manual movement of the lockout button assembly between a blocking position and a non-blocking position.

U.S. Pat. No. 11,391,539 to Lance et al. describes a holster system that includes a holster and an accessory designed to be fixed to a mounting rail of a handgun. The holster has a holster body having opposing wall portions defining a cavity. A retention mechanism of the holster system has a blocking portion movable between a blocking position and a non-blocking position. The blocking member at least inhibits removal of the handgun and accessory if the handgun and accessory are urged rearwardly before a thumb receiving portion is depressed. The blocking portion is on a spring member that is deflected by an elongate exteriorly extending sliding member having a cam surface that selectively deflects the spring member from the blocking position.

U.S. Pat. No. 11,333,463 to Flores describes a firearm holster safety retention assembly designed to prevent unauthorized extraction of a firearm from the holster or accidental release of the firearm from the holster. The holster retention assembly includes a saddle receiving the barrel of a firearm and a pivot release arm connecting to the saddle to restrict movement (or release) of the firearm from the holster. The pivot release arm connects to the saddle. The saddle and the pivot release arm each have interlocking wedges to restrict forceful removal of the firearm from the holster. The saddle includes a pivot stop to prevent overleveraging of the pivot release arm.

In sum, the prior art disadvantageously requires constant pressure add to the holster through, for example, engaging a release button or the like during the process of drawing the holstered firearm. Holsters that require a button to be pushed while withdrawing a firearm can create a hazardous situation that may, in certain situations, cause a shooter to inadvertently discharge a weapon or at least result in a slower draw. Moreover, unlocking a firearm from a holster while holding down a button can create the conditions for an unsafe or an unnatural draw.

As can be seen, there is a need for an improved holster design for a firearm incorporating a singular toggle switch that need not be engaged during the drawing process so that a safe, smooth natural draw is achieved.

SUMMARY OF THE INVENTION

A slide-locking mechanism for a firearm holster is summarized as follows. The holster is sized and configured for retaining a firearm, such as a handgun, having a gun body having a trigger guard. The holster defines a pocket, a lock guide, and a cavity that communicates the pocket with the lock guide by way of a passage for facilitated the binary toggle switch that moves between an unlocked mode and a locked mode that prevents the draw of the firearm by locking its trigger guard within the pocket.

The pocket is sized and configured for housing a portion of the firearm and the trigger guard of the firearm. The lock guide includes a spaced-apart pair of slots. The cavity is located between the slots. The cavity further defines an inner ledge and an inner wall. The inner wall is oriented transverse to the ledge. The inner ledge and the inner wall of the holster define a niche located adjacent to the passage of the cavity and between the slots.

The slide-locking mechanism includes a lock plunger dimensioned and configured for slidable insertion into and retractable removal from the cavity. The slide-locking mechanism of the present subject matter further includes a compression spring dimensioned and configured for insertion in the niche.

The lock plunger includes a bottom surface and an extension sized and configured for compressing the spring against the inner wall.

The slide-locking mechanism of the present subject matter further includes a lock slider that includes a spaced-apart pair of outwardly extending slider wings. The spaced-apart slider wings are dimensioned and configured for fitting and slidingly engaging within the spaced-apart pair of longitudinally oriented slots that are formed within the lock guide.

The plunger includes a first inclined surface and further includes a second inclined surface spaced from the first inclined surface. The slider includes a slider inclined surface dimensioned and configured for slidably engaging the first inclined surface of the plunger. Sliding the slider inclined surface across the plunger first inclined surface, toward the plunger, causes the plunger to move within the cavity. In operation, the plunger is moved by a user between a locked position where the plunger bottom surface causes the trigger guard to be retained within the pocket and an unlocked position where the plunger does not contact the trigger guard.

In one aspect of the present invention, a toggle locking mechanism combined with a firearm holster includes the following: a holster body dimensioned and configured for retaining a firearm, wherein the firearm defines a gun body having a trigger guard, and wherein the holster defines the following: a pocket sized and configured for retaining the trigger guard; a lock guide including a spaced-apart pair of slots; a cavity located between the slots; a passage communicating the cavity with the pocket; a plunger disposed in the passage, wherein the plunger is biased in an unlocked position spaced from the pocket; a slider ridable along the slots between a unlocked mode and a locked mode, wherein the locked mode urges the slider against the plunger so that the plunger toggles from the unlocked position to a locked position where the plunger retains the trigger guard within the pocket, wherein maintaining the slider in the locked mode or the unlocked mold requires work.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Referring to FIGS. 1 through 6A, the present invention provides a toggle locking mechanism 10 for a firearm holster 12. The illustrated embodiment of the holster 12 is dimensioned and configured for retaining a firearm 11, such as a handgun. The firearm 11 includes a gun body 11A having a trigger guard 11B.

The holster 12 provides a trigger guard pocket 12A along the interior of the holster 12. The holster provides a lock guide 12B along its exterior surface, wherein the lock guide 12B circumscribes a cavity 15 that communicates the exterior surface to the trigger guard pocket 12A by way of a passage. The trigger guard pocket 12A is dimensioned and configured for retaining the trigger guard 11B so that a forward portion of the trigger guard is adjacent to the passage.

Figure 1:
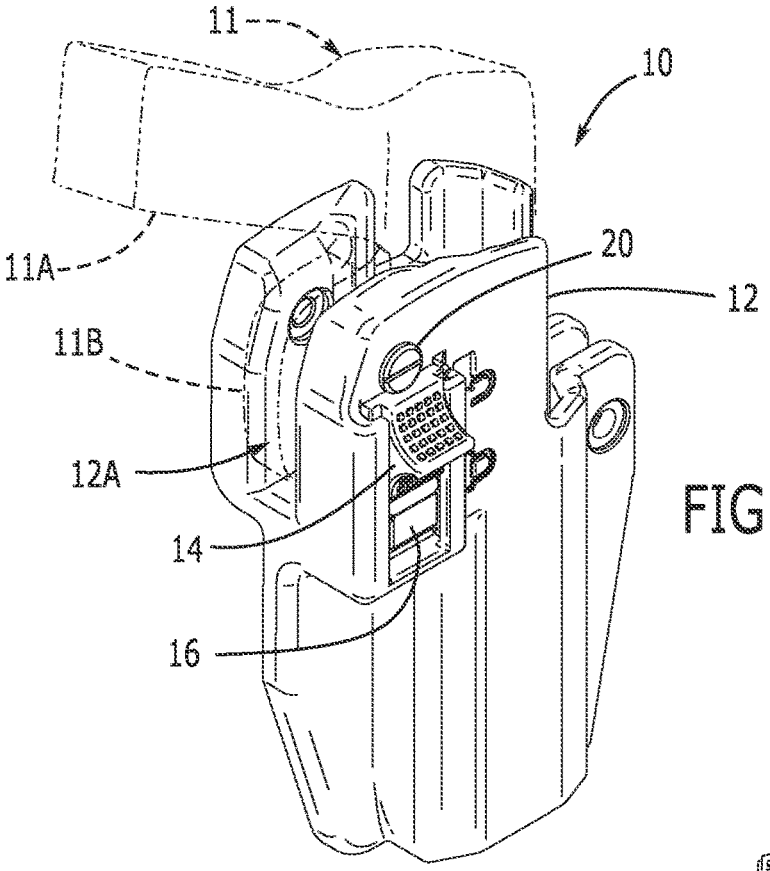
FIG. 1 is a top perspective view of an exemplary embodiment of the present invention, shown in use.
Figure 2:
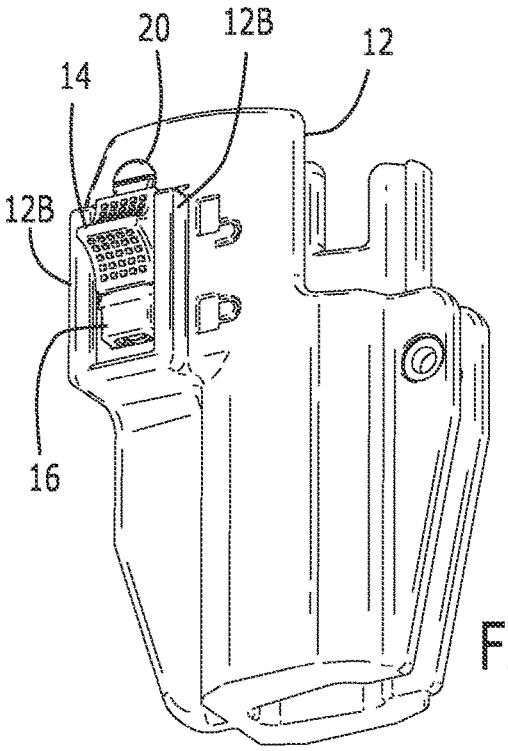
FIG. 2 is a bottom perspective view of an exemplary embodiment of the present invention.
Figure 3:
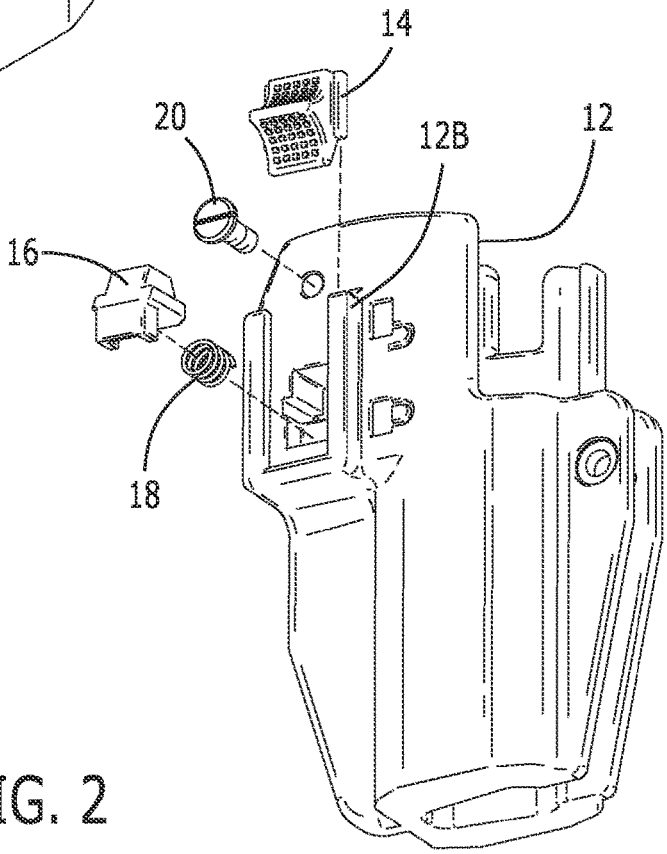
FIG. 3 is an exploded bottom perspective view of an exemplary embodiment of the present invention.
Figure 3A:
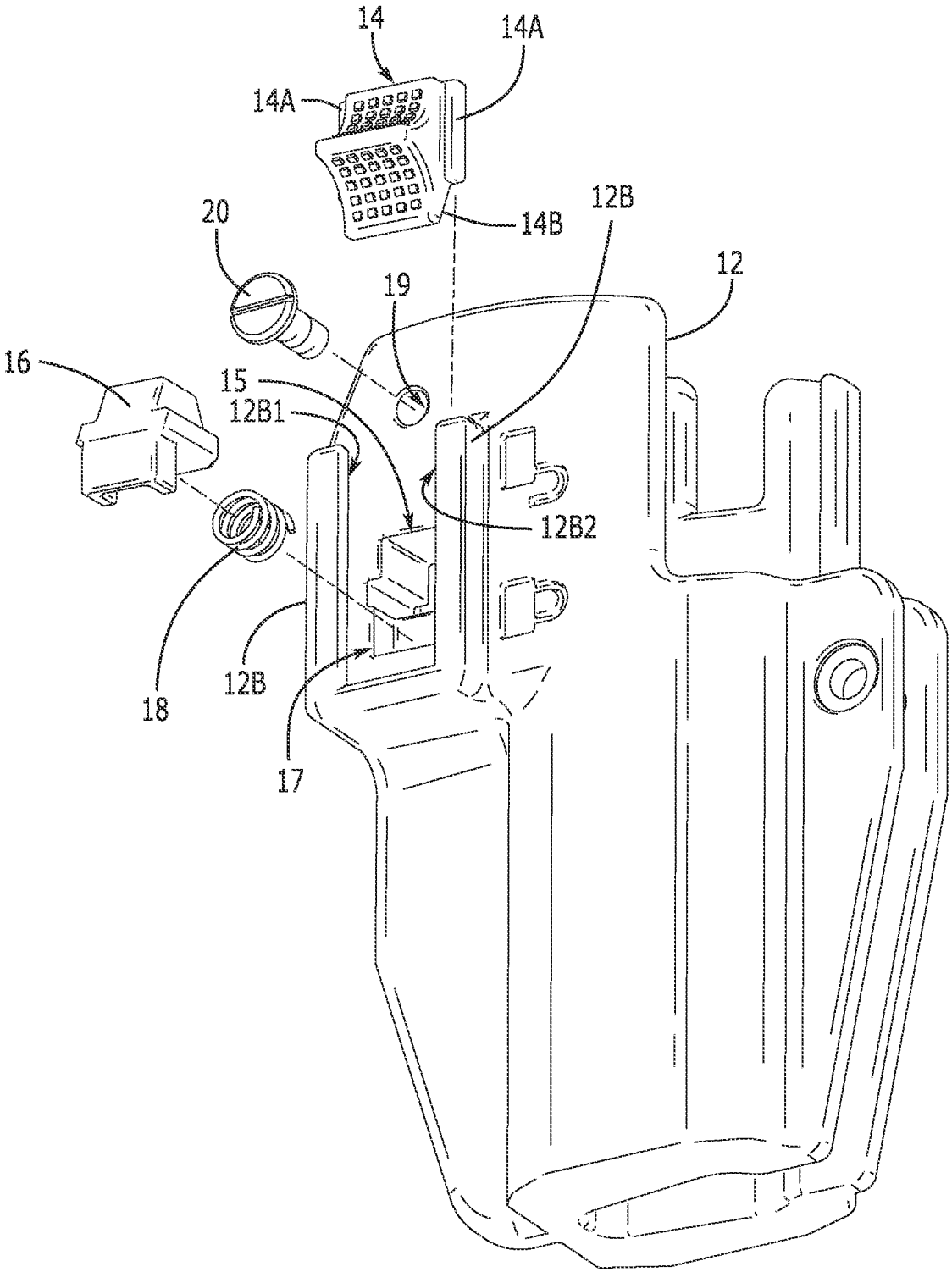
FIG. 3A is an enlarged view of FIG. 3.
Figure 4:
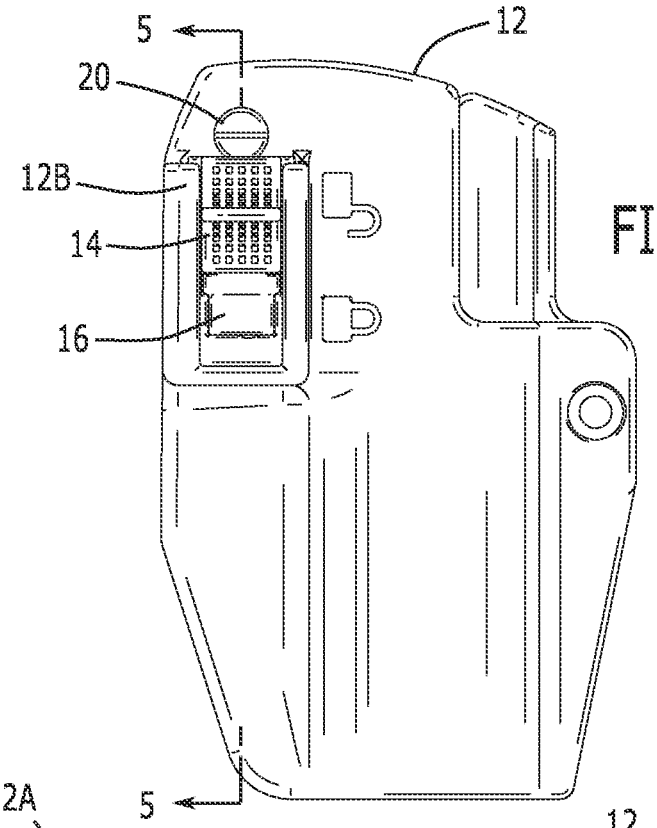
FIG. 4 is a side elevation of an exemplary embodiment of the present invention.

The lock guide structure 12B, which may project outwardly from the holster 12, straddles a lock slider 14, as shown in FIG. 2. The lock guide structure 12B includes a spaced-apart pair of elongated slots or rails 12B1, 12B2. The lock slider 14 provides a pair of slider wings 14A, each slider wing 14A extends outwardly from opposing edges of the lock slider 14. The slider wings 4A are sized and configured for fitting within and slidingly engaging within the spaced-apart pair of longitudinally oriented slots or rails 12B1, 12B2 that are formed within the lock guide 12B.

The cavity 15 is located between the elongated slots 12B1, 12B2. Subjacent the cavity 15, and also between the elongated slots 12B1, 12B2, is a niche 17. The niche 17 defines an inner ledge 17A and an inner wall 17B. The inner wall 17B may be oriented transverse to the ledge 17A. The inner wall extends between the inner ledge 17A and a floor of the passage.

The toggle lock mechanism 10 includes a lock plunger 16 dimensioned and configured for slidable insertion into and retractable removal from the cavity 15. The toggle lock mechanism 10 of the present subject matter further includes a compression spring 18, as shown in FIGS. 3, 3A, 5, 5A, 6, and 6A. The compression spring 18 is dimensioned and configured for operable insertion within niche 17.

Figure 5:
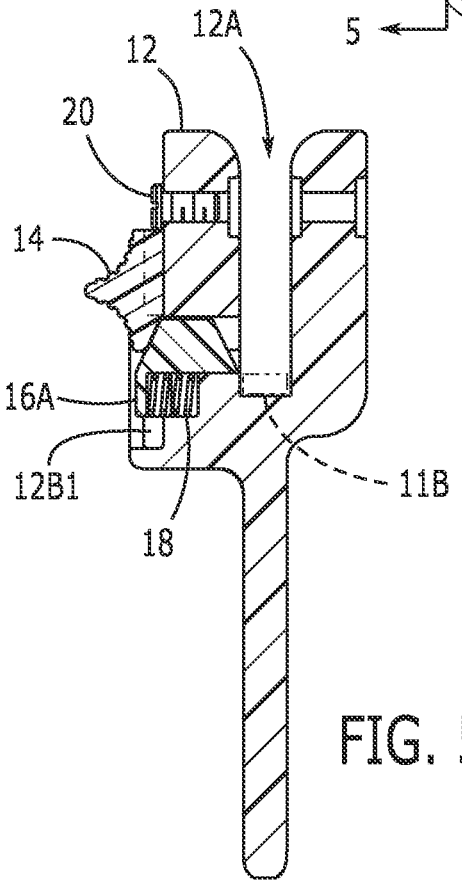
FIG. 5 is a cross-sectional view of an exemplary embodiment of the present invention, taken on line 5-5 of FIG. 4, showing the exemplary embodiment of the present invention in an unlocked mode.
Figure 6:
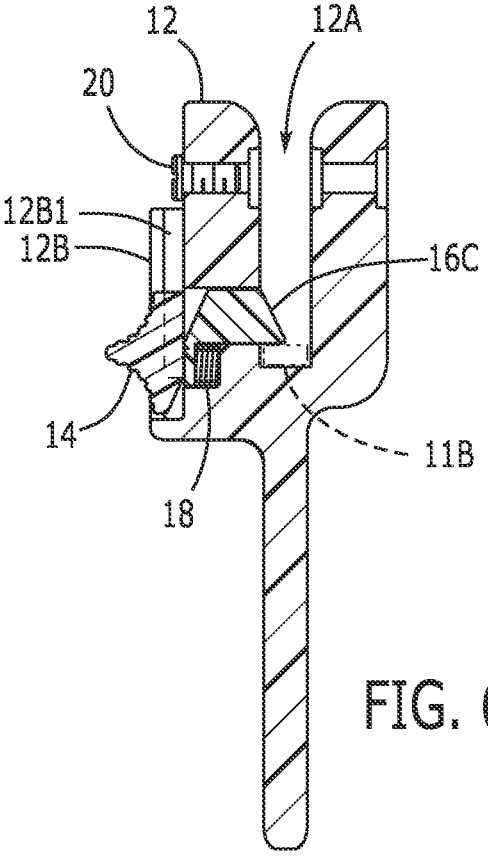
FIG. 6 is a cross-sectional view, like FIG. 5, though showing the exemplary embodiment of the present invention in a locked mode.
Figure 5A:
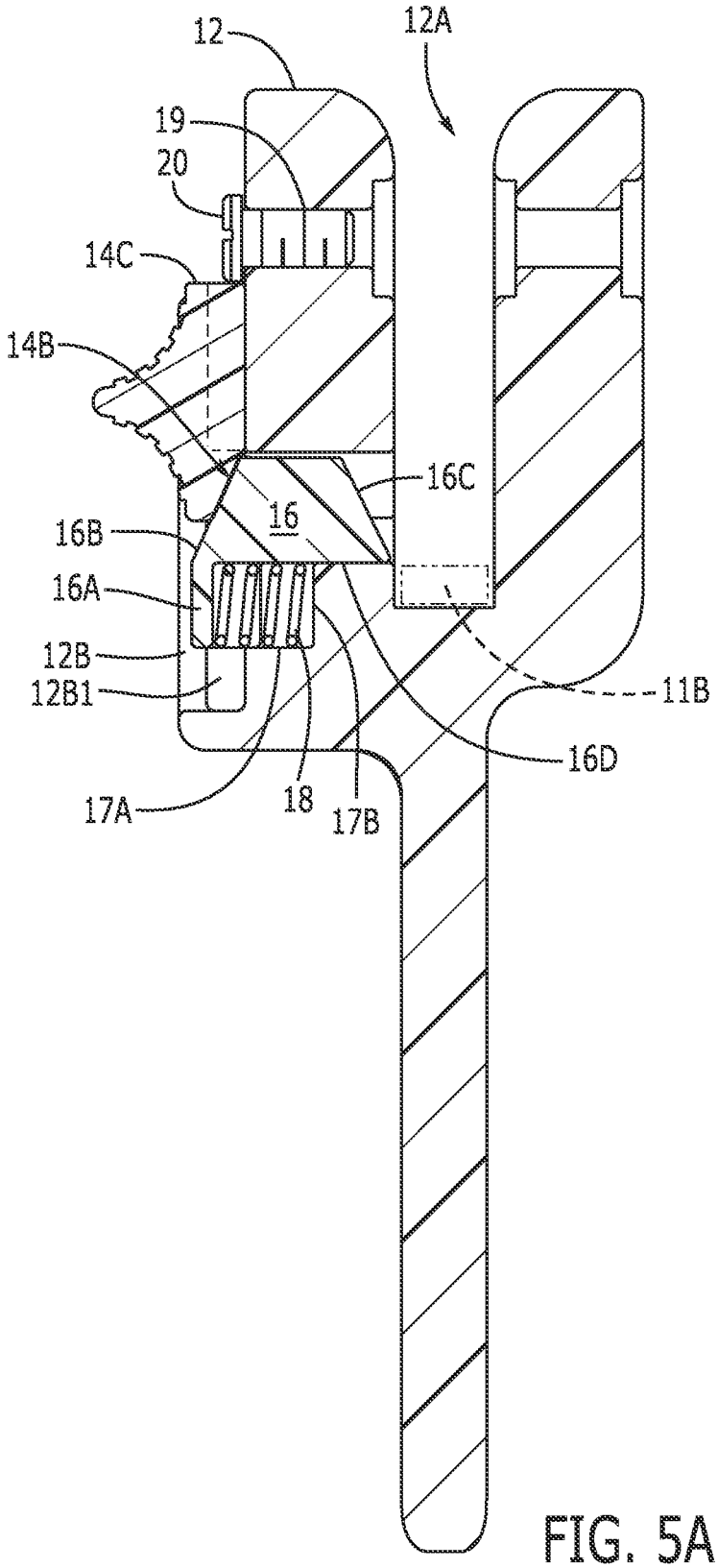
FIG. 5A is an enlarged view of FIG. 5.
Figure 6A:
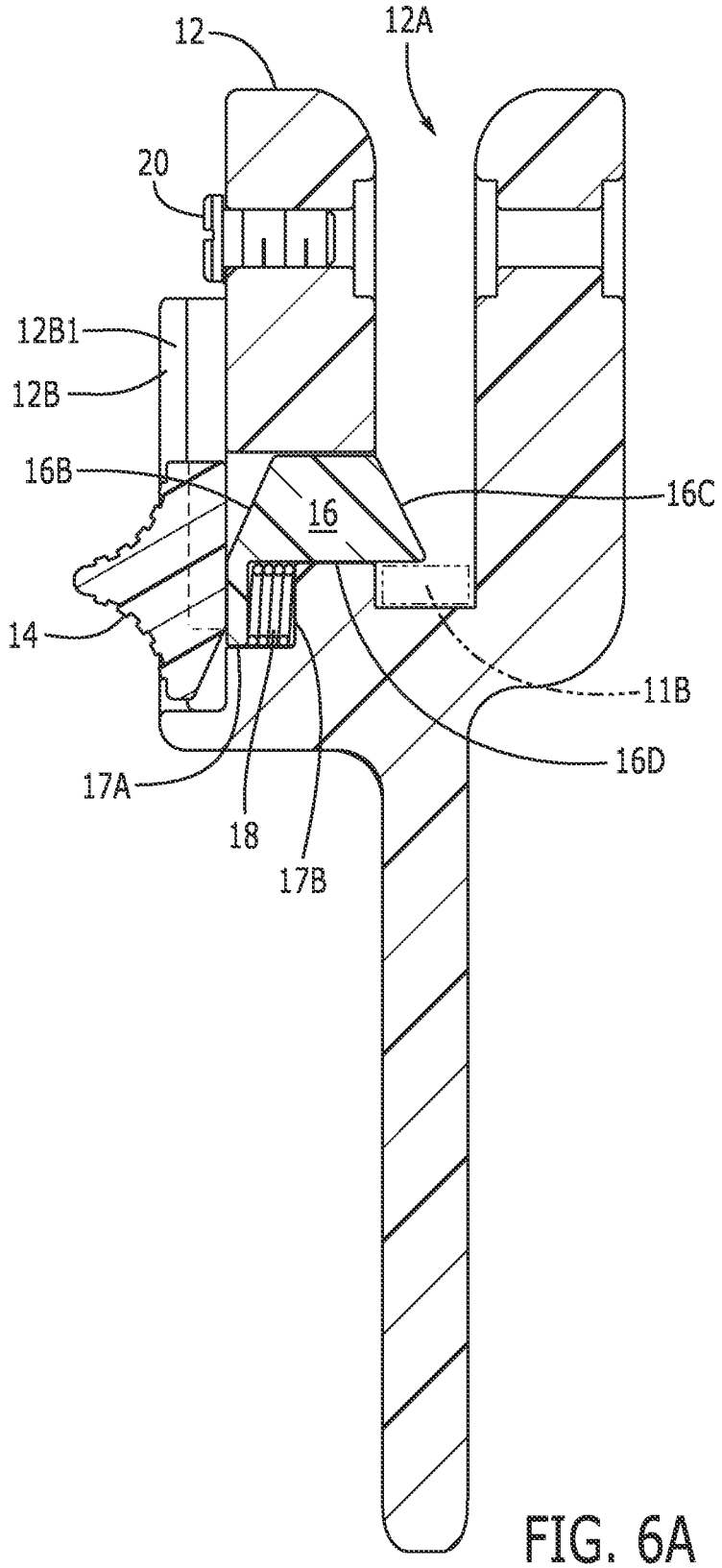
FIG. 6A is an enlarged view of FIG. 6.

The lock plunger 16 includes a bottom surface 16D, as shown in FIGS. 5A and 6A, and an extension 16A, as shown in FIGS. 5 and 5A, that is dimensioned and configured for enabling a user to compress the spring 18 against the inner wall 17B. The bottom surface 16D and the extension 16A box the spring 18 within the niche 17.

The plunger 16 includes a first inclined surface 16B and further includes a second inclined surface 16C spaced from the first inclined surface 16B. The slider 14 includes a slider inclined surface 14B dimensioned and configured for slidably engaging the first inclined surface 16B of the plunger 16. Urging the slider inclined surface 14B across the plunger first inclined surface 16B, toward the plunger 16, causes the plunger 16 to move inward through the passage.

In operation, the plunger is spring-biased in the unlocked position. In the unlocked position, the plunger 16 does not substantially project into the trigger guard pocket 12A, as either the slider 14 is not in contact with the plunger 16 or not sufficiently urged against the first inclined plunger surface 16B. The plunger 16 is moved by a user between the unlocked position to a locked position where a portion of the plunger bottom surface 16D causes the trigger guard 11B to be held within the trigger guard pocket 12A by urging the slider inclined surface 14B against the first inclined plunger surface 16B. This typically involves sliding the slider 14 downward along the lock guide rails 12B1, 12B2. Again, in the unlocked position where the plunger 16 does not contact the trigger guard 11B. Toggling from the locked position to the unlocked position involves urging the slider 14 to ride upward along the rials 12B1, 12B2, which because of the spring-biased nature of the plunger 16, causes the plunger 16 to move within the passage to the unlocked position, where the plunger 16 does not contact the trigger guard 11B.

The holster body 12 further includes an externally threaded member 20, such as a machine screw. Moreover, the holster body 12 further defines an opening or an aperture 19 having internal threads with which the threaded member 20 external threads rotatably mesh. The lock slider 14 defines a slider upper surface 14C dimensioned and configured to abuttingly engage the threaded member 20.

Illustrated and described is a slide-locking mechanism for a firearm holster. While the present subject matter is described in relation to a single illustrated embodiment, the present subject matter is not to be limited to the presently illustrated embodiment. On the contrary, many alternatives, changes, and/or modifications will become apparent to a person of ordinary skill in the art after reading and reviewing this patent specification in relation to its various figures. Thus, all such alternatives, changes, and/or modifications are to be viewed as forming a part of the present subject matter insofar as they fall within the spirit and scope of the appended claims.

As used in this application, the term "about" or "approximately" refers to a range of values within plus or minus 10% of the specified number. And the term "substantially" refers to up to 80% or more of an entirety. Recitation of ranges of values herein are not intended to be limiting, referring instead individually to any and all values falling within the range, unless otherwise indicated, and each separate value within such a range is incorporated into the specification as if it were individually recited herein.

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length"

means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the invention as set forth in the following claims.

What is claimed is:

1. A slide-locking mechanism for a firearm holster, comprising:

a holster dimensioned and configured for retaining a firearm, wherein the firearm defines a gun body having a trigger guard, and wherein the holster defines:

a pocket sized and configured for retaining the trigger guard;

a lock guide including a spaced-apart pair of slots;

a cavity located between the slots;

a passage communicating the cavity with the pocket;

an inner ledge and an inner wall transverse to the ledge, wherein the inner ledge and wall define a niche located subjacent the cavity and between the slots;

a plunger sized and configured for insertion within the cavity;

a spring sized and configured for insertion within the niche, wherein the plunger defines a bottom surface and an extension dimensioned and configured for compressing the spring against the inner wall so that the lock plunger is biased in an unlocked position; and a slider defining a spaced-apart pair of slider extensions dimensioned and configured for slidingly engaging within the spaced-apart pair of slots, wherein the plunger defines a first inclined surface, wherein the slider defines a slider inclined surface for slidably engaging the first inclined surface of the plunger, and wherein the plunger is movable within the cavity between a locked position where the bottom surface of the plunger retains the trigger guard within the pocket and the unlocked position where the plunger is spaced from the trigger guard.

2. The slide-locking mechanism of claim 1, wherein the firearm is a handgun.

3. The slide-locking mechanism of claim 1, wherein the spring is a compression spring.

4. The slide-locking mechanism of claim 1, wherein the holster further includes an externally threaded member, and wherein the holster further defines an aperture having internal threads with which the threaded member external threads rotatably mesh.

5. The slide-locking mechanism of claim 4, wherein the slider defines a slider upper surface dimensioned and configured for abuttingly engaging the threaded member.

6. A toggle locking mechanism combined with a firearm holster, comprising:

a holster dimensioned and configured for retaining a firearm, wherein the firearm defines a gun body having a trigger guard, and wherein the holster defines:

a pocket that is sized and configured for retaining the trigger guard;

a lock guide including a spaced-apart pair of slots;

a cavity located between the slots;

a passage communicating the cavity with the pocket;

a plunger disposed in the passage, wherein the plunger is biased in an unlocked position spaced from the pocket;

a slider ridable along the slots between a unlocked mode and a locked mode, wherein the locked mode urges the slider against the plunger so that the plunger toggles from the unlocked position to a locked position where the plunger retains the trigger guard within the pocket, wherein maintaining the slider in the locked mode or the unlocked mode requires work.

* * * * *